US009254521B2

(12) United States Patent
Waniuk et al.

(10) Patent No.: US 9,254,521 B2
(45) Date of Patent: Feb. 9, 2016

(54) METHODS OF MELTING AND INTRODUCING AMORPHOUS ALLOY FEEDSTOCK FOR CASTING OR PROCESSING

(71) Applicants: Apple Inc., Cupertino, CA (US); Crucible Intellectual Property, LLC, Rancho Santa Margarita, CA (US)

(72) Inventors: Theodore A. Waniuk, Lake Forest, CA (US); Joseph Stevick, Olympia, WA (US); Sean O'Keeffe, San Francisco, CA (US); Dermot J. Stratton, San Francisco, CA (US); Joseph C. Poole, San Francisco, CA (US); Matthew S. Scott, Campbell, CA (US); Christopher D. Prest, San Francosco, CA (US)

(73) Assignees: Apple Inc., Cupertino, CA (US); Crucible Intellectual Property, LLC, Rancho Santa Margarita, CA (US)

( * ) Notice: Subject to any disclaimer, the term of this patent is extended or adjusted under 35 U.S.C. 154(b) by 0 days.

(21) Appl. No.: 14/284,471

(22) Filed: May 22, 2014

(65) Prior Publication Data

US 2014/0251568 A1 Sep. 11, 2014

Related U.S. Application Data

(62) Division of application No. 13/628,542, filed on Sep. 27, 2012, now Pat. No. 8,813,816.

(51) Int. Cl.

| | |
|---|---|
| ***B22D 17/10*** | (2006.01) |
| ***B22D 17/08*** | (2006.01) |
| ***C22C 45/00*** | (2006.01) |

(52) U.S. Cl.

CPC ..... *B22D 17/10* (2013.01); *B22D 17/08* (2013.01); *C22C 45/00* (2013.01)

(58) Field of Classification Search

CPC ..... B22D 17/08; B22D 17/10; B22D 17/30
USPC ..... 164/113, 312
See application file for complete search history.

(56) References Cited

U.S. PATENT DOCUMENTS

| | | | |
|---|---|---|---|
| 3,172,174 | A | 3/1965 | Johnson |
| 3,181,212 | A | 5/1965 | Madwed |

(Continued)

FOREIGN PATENT DOCUMENTS

| | | |
|---|---|---|
| EP | 134336 | 3/1985 |
| EP | 0845316 | 6/1998 |

(Continued)

OTHER PUBLICATIONS

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp. 808-813.

(Continued)

*Primary Examiner* — Kevin E Yoon
(74) *Attorney, Agent, or Firm* — Brownstein Hyatt Farber Schreck, LLP

(57) ABSTRACT

Various embodiments provide apparatus and methods for melting and introducing alloy feedstock for molding by using a hollow branch having a constraint mechanism therein. In one embodiment, a hollow branch can extend upward from a cold chamber that is substantially horizontally configured. The hollow branch including a constraint mechanism can be capable of containing an alloy feedstock for melting into the molten alloy in the hollow branch and introducing the molten alloy to the cold chamber for molding.

15 Claims, 4 Drawing Sheets

(56) References Cited

U.S. PATENT DOCUMENTS

| | | | | |
|---|---|---|---|---|
| 3,283,370 | A | 11/1966 | Jendraszkiewicz | |
| 3,731,727 | A | 5/1973 | Mitamura et al. | |
| 3,779,743 | A | 12/1973 | Olsson | |
| 4,271,895 | A | 6/1981 | Cole | |
| 4,489,771 | A | 12/1984 | Takeshima | |
| 4,758,147 | A | 7/1988 | Inaba | |
| 5,288,344 | A | 2/1994 | Peker et al. | |
| 5,368,659 | A | 11/1994 | Peker et al. | |
| 5,618,359 | A | 4/1997 | Lin et al. | |
| 5,643,528 | A | 7/1997 | Le Gras | |
| 5,711,363 | A | 1/1998 | Scruggs et al. | |
| 5,735,975 | A | 4/1998 | Lin et al. | |
| 5,787,959 | A | 8/1998 | Laxmanan et al. | |
| 5,896,642 | A | 4/1999 | Peker et al. | |
| 5,934,357 | A | 8/1999 | Sawtell | |
| 5,979,535 | A | 11/1999 | Sakamoto | |
| 5,988,197 | A | 11/1999 | Colin | |
| 6,021,840 | A | 2/2000 | Colvin | |
| 6,189,600 | B1 | 2/2001 | Taniguchi et al. | |
| 6,267,170 | B1 | 7/2001 | Onuki et al. | |
| 6,267,171 | B1 | 7/2001 | Onuki et al. | |
| 6,283,197 | B1 | 9/2001 | Kono | |
| 6,325,868 | B1 | 12/2001 | Kim et al. | |
| 6,371,195 | B1 | 4/2002 | Onuki et al. | |
| 6,427,753 | B1 | 8/2002 | Inoue et al. | |
| 6,540,006 | B2 * | 4/2003 | Kono | B22D 17/007 164/113 |
| 6,619,370 | B2 | 9/2003 | Sakamoto et al. | |
| 6,666,258 | B1 * | 12/2003 | Kono | B22D 17/28 164/312 |
| 6,875,293 | B2 | 4/2005 | Peker | |
| 7,017,645 | B2 | 3/2006 | Johnson et al. | |
| 7,159,639 | B2 | 1/2007 | Tsuzuki | |
| 7,331,375 | B2 | 2/2008 | Suzuki | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,694,715 | B2 * | 4/2010 | Czerwinski | B22D 17/007 164/113 |
| 7,708,844 | B2 | 5/2010 | Muramatsu et al. | |
| 7,784,525 | B1 | 8/2010 | Dai | |
| 7,906,219 | B2 | 3/2011 | Ohara et al. | |
| 2001/0023755 | A1 | 9/2001 | Kono | |
| 2002/0005233 | A1 | 1/2002 | Schirra et al. | |
| 2003/0222122 | A1 | 12/2003 | Johnson | |
| 2003/0230392 | A1 | 12/2003 | Czerwinski | |
| 2004/0261970 | A1 | 12/2004 | Withers et al. | |
| 2005/0028961 | A1 | 2/2005 | Toyoshima et al. | |
| 2005/0242454 | A1 | 11/2005 | Yuasa et al. | |
| 2006/0042772 | A1 | 3/2006 | Fujikawa | |
| 2006/0096733 | A1 | 5/2006 | Czerwinski | |
| 2006/0177683 | A1 | 8/2006 | Ballyns | |
| 2006/0254747 | A1 | 11/2006 | Ishida et al. | |
| 2007/0079907 | A1 | 4/2007 | Johnson et al. | |
| 2007/0267779 | A1 | 11/2007 | Manda | |
| 2008/0135136 | A1 | 6/2008 | Demetriou et al. | |
| 2008/0279974 | A1 | 11/2008 | Saggese | |
| 2008/0295989 | A1 | 12/2008 | Czerwinski | |
| 2008/0305387 | A1 | 12/2008 | Murray et al. | |
| 2008/0311418 | A1 | 12/2008 | Czerwinski | |
| 2009/0162629 | A1 | 6/2009 | Demetriou et al. | |
| 2009/0236494 | A1 | 9/2009 | Hata et al. | |
| 2009/0321037 | A1 | 12/2009 | Lewis et al. | |
| 2010/0084052 | A1 | 4/2010 | Farmer et al. | |
| 2010/0230012 | A1 | 9/2010 | Demetriou et al. | |
| 2010/0300148 | A1 | 12/2010 | Demetriou et al. | |
| 2011/0079940 | A1 | 4/2011 | Schroers et al. | |
| 2011/0108231 | A1 | 5/2011 | Zheng et al. | |

FOREIGN PATENT DOCUMENTS

| | | |
|---|---|---|
| EP | 1013363 | 6/2000 |
| EP | 1415740 | 5/2004 |
| FR | 2665654 | 2/1992 |
| JP | 6212205 | 8/1994 |
| JP | 9272929 | 10/1997 |
| JP | 2000326065 | 11/2000 |
| JP | 2001303218 | 10/2001 |
| JP | 2004050269 | 2/2004 |
| JP | 2010036210 | 2/2010 |
| WO | WO0037201 | 6/2000 |
| WO | WO2008046219 | 4/2008 |
| WO | WO2009067512 | 5/2009 |

OTHER PUBLICATIONS

Inoue et al., "Bulk amorphous alloys with high mechanical strength and good soft magnetic properties in Fe—Tm—B(TM=IV-VIII group transition metal) system", Appl. Phys. Lett., vol. 710, p. 464 (1997).

International Search Report issued in PCT/US2011/054153, mailed Jun. 13, 2012.

International Search Report issued in PCT/US2011/056399, mailed Jul. 9, 2012.

International Search Report issued in PCT/US2011/060313, mailed Jul. 17, 2012.

Kargahi et al., "Analysis of failure of conducting crucible used in induction metal", Aug. 1988.

McDeavitt et al., "High Temperature Interaction Behavior at Liquid Metal-Ceramic Interfaces", Journal of Materials Engineering and Performance, vol. 11, Aug. 2002.

Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

* cited by examiner

PRIOR ART

PRIOR ART

METHODS OF MELTING AND INTRODUCING AMORPHOUS ALLOY FEEDSTOCK FOR CASTING OR PROCESSING

CROSS-REFERENCE TO RELATED APPLICATIONS

The present application is a divisional of U.S. patent application Ser. No. 13/628,542, filed Sept. 27, 2012, which Applicant claims the benefit of priority and is being incorporated by reference herein in its entirety.

FIELD

The present disclosure is generally related to molding of metal alloys, and more particularly, related to apparatus and methods for melting and introducing amorphous alloy feedstock using a hollow branch connected to a cold chamber.

BACKGROUND

Some injection molding machines use a melt chamber to melt material. The molten material can be poured from the melt chamber into a cold chamber via a pour hole. The molten material can then be injected by a plunger through the cold chamber into a mold for molding.

SUMMARY

A proposed solution according to embodiments herein provides apparatus and methods of melting and introducing alloy feedstock into a cold chamber or other article forming apparatus through a simplified containment and pouring system.

In accordance with various embodiments, there is provided an apparatus comprising a cold chamber substantially horizontally configured and connected to a mold configured for molding a molten alloy into a BMG part; and a hollow branch extending upward from a region of the cold chamber having an upward angle with respect to a horizontal axis, the hollow branch comprising a constraint mechanism capable of containing both a solid alloy feedstock during melting into the molten alloy in the hollow branch and the molten alloy prior to introducing the molten alloy to the cold chamber for molding; wherein the interface between the constraint mechanism and the molten alloy is substantially non-wetting to the molten alloy. The apparatus could further comprise a heating component configured for association with the hollow branch to provide a melt zone along the hollow branch. The apparatus could further comprise a plunger configured to push the molten alloy from the cold chamber into the mold. Optionally, the upward angle of the hollow branch with respect to the horizontal axis is between 0° and 180°. Optionally, a distance between the mold and the hollow branch along the horizontal axis comprises a minimum distance. Optionally, the constraint mechanism comprises a surface having a regulated surface temperature. Optionally, the constraint mechanism comprises a plurality of fingers, a constriction, a step, a plate, a rod, a detent, or their combinations, extended from a side of a wall of the hollow branch and configured within the hollow branch. Optionally, the constraint mechanism provides a narrowed horizontal opening within the hollow branch to block the alloy feedstock pass through. Optionally, the constraint mechanism is retractable or rotatable to adjust an opening within the hollow branch. Optionally, the apparatus comprises a die-casting apparatus that does not include a melt crucible. Optionally, the cold chamber is shielded from a heating component associated with the hollow branch.

In accordance with various embodiments, there is provided a method. In this method, a cold chamber can be substantially horizontal configured and connected to a mold for molding a molten alloy. A hollow branch can then be configured extending upward from a region of the cold chamber. The hollow branch can have an upward angle with respect to a horizontal axis. A heating component can be configured to be associated with at least a portion of the hollow branch to provide a melt zone at least in the hollow branch. A constraint mechanism can be configured in the hollow branch to hold an alloy feedstock thereon, with the alloy feedstock being melted into the molten alloy in the melt zone, and to introduce the molten alloy from the hollow branch into the cold chamber for molding. The method could further comprise controlling a distance between the mold and the hollow branch along the horizontal axis. The method could further comprise configuring a plunger rod to push the molten alloy from the cold chamber into the mold. Optionally, the distance is controlled to be minimal. Optionally, the configuring of the hollow branch comprises controlling the upward angle and/or controlling a length of the hollow branch. Optionally, the configuring of the constraint mechanism comprises configuring a plurality of fluid-cooled fingers or grids such that the alloy feedstock and/or the molten material do not flow into the cold chamber from the hollow branch under gravity when melting. Optionally, the heating component is configured such that the melt zone is adjustable above the constraint mechanism in the hollow branch.

In accordance with various embodiments, there is provided a method. In this method, a molding apparatus can be obtained including a cold chamber substantially horizontally configured and connected to a mold for molding a molten material, and a hollow branch extending upward from a region of the cold chamber having an upward angle with respect to a horizontal axis. An alloy feedstock can be placed on a constraint mechanism configured in the hollow branch and be heated to form the molten material in the hollow branch. The molten material can then be introduced from the hollow branch into the cold chamber and injected from the cold chamber into the mold for molding. The method could further comprise regulating a surface temperature of the constraint mechanism, while heating the alloy feedstock. The method could further comprise using a plunger to inject the molten material into the mold, wherein the molten material travels a minimum distance in the cold chamber into the mold. Optionally, the introducing of the molten material from the hollow branch into the cold chamber comprises retracting the constraint mechanism from the hollow branch to provide an opening sufficiently large to pass the molten material there-through. Optionally, the constraint mechanism comprises a plurality of fingers or grids and wherein the introducing of the molten material comprises rotating the constraint mechanism or one or more fingers or grids thereof to provide an opening to introduce the molten material there-through. Optionally, the heating of the alloy feedstock comprises one or more processes of an induction heating, a joule heating, a radiation heating, and a combination thereof. Optionally, the constraint mechanism provides a narrowed horizontal opening in the hollow branch to hold the alloy feedstock in place. Optionally, the heating comprises controlling a melt zone along the hollow branch to melt the alloy feedstock directionally starting from a top side and ending at a bottom side until at the constraint mechanism, wherein the molten alloy passes through the narrowed opening into the cold chamber.

In one certain embodiment, the cold chamber can be understood as containing a hollow branch extending upward from the region where the pour hole usually is. In this branch, alloy feedstock is melted using induction, joule heating, or radiation while being contained by water-cooled fingers below. Surface tension prevents the alloy from pouring under the force of gravity into the cold chamber until the fingers are retracted, at which point the casting process proceeds normally. In another embodiment, solid alloy feedstock is inserted into the hollow branch and held in place by any constraint mechanism, such as, for example, a constriction, step, or detent. By inductively melting the feedstock directionally starting at the point furthest from the cold chamber, the pieces can be kept in place until the cold end melts sufficiently to pour passing the constriction and into the cold chamber.

In embodiments, the alloy material can be melted in a zone separate from the cold chamber into which the molten material can be poured and a plunger can then push the molten material into the mold. The present teachings can allow the use of a cold copper crucible to prevent skin layer formation. Also, separating the melting process from the molding process allows one to form clean molten material, which can possibly be filtered of any undesirable material, before pouring the molten material in the cold chamber.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
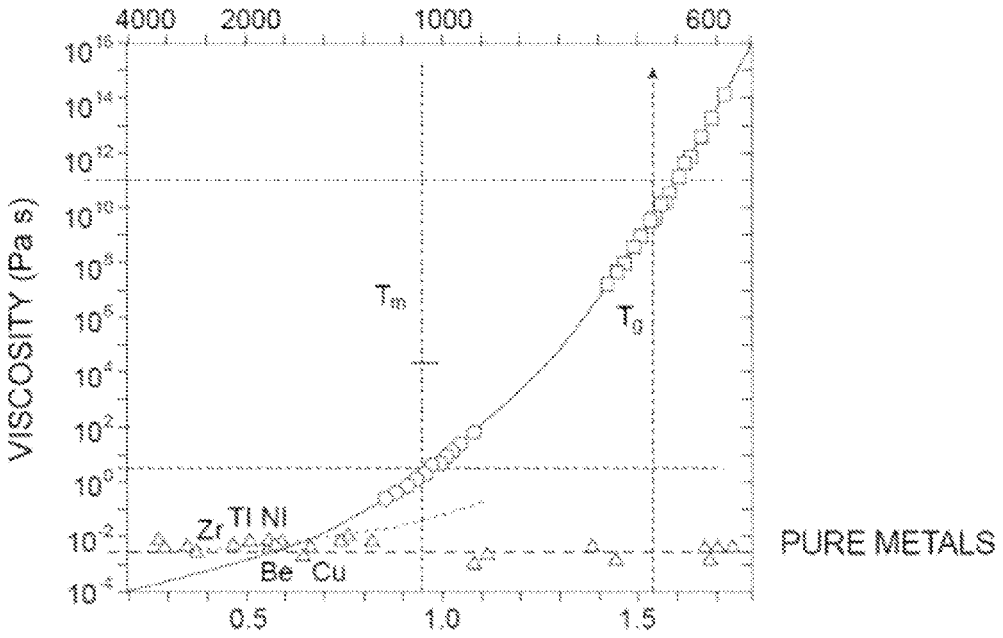
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
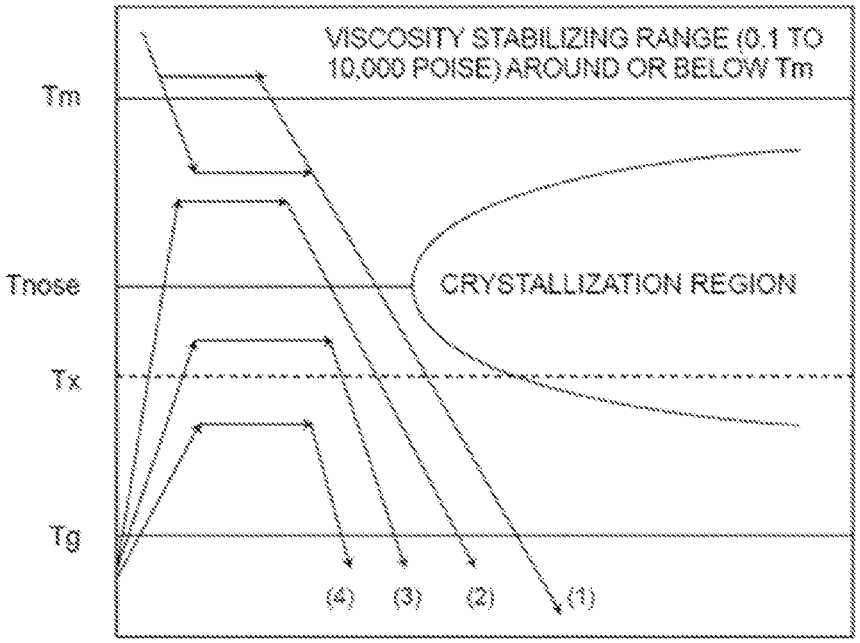
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^5$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can include multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can include a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can include multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy"

refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically includes a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can include the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |

TABLE 2-continued

| Additional Exemplary amorphous alloy compositions (atomic %) | | | | | | |
|---|---|---|---|---|---|---|
| Alloy | Atm % | Atm % | Atm % | Atm % | Atm % | Atm % |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0305387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln—C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions $Fe_{80}P_{12.5}$C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include $Pd_{44.48}Cu_{32.35}Co_{4.05}P_{19.11}$, $Pd_{77.5}Ag_6Si_9P_{7.5}$, and $Pt_{74.7}Cu_{1.5}Ag_{0.3}P_{18}$B4$Si_{1.5}$.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Embodiments herein relate to various means of melting and introducing BMG feedstock into a cold chamber or other forming apparatus through a simplified containment and pouring system. In one embodiment, a cold chamber contains an additional "branch" extending upward from the region where the pour hole usually is. In this branch, alloy feedstock is melted using induction, joule heating, or radiation while being contained by water-cooled fingers below. The interface between the water-cooled fingers and the molten alloy is substantially non-wetting. Surface tension prevents the alloy from pouring under the force of gravity into the cold chamber until the fingers are retracted, at which point the casting process proceeds normally. In another embodiment, solid alloy feedstock is inserted into the branch and held in place by a constriction, step, or detent. By inductively melting the feedstock directionally starting at the point furthest from the cold chamber, the piece can be kept in place until the cold end melts sufficiently to pour past the constriction and into the cold sleeve.

Advantages of the embodiments include that the alloy material would be molten in a zone separate from the cold chamber into which the molten material would be poured into and a plunger would then push the molten material into the mold. This method allows the use of a cold copper crucible to prevent contamination. Also, separating the melting process from the molding process allows one to form clean molten material that could possibly be filtered of any undesirable material, before pouring the molten material in the cold chamber crucible.

As used herein, the term "wetting" refers to spreading of a liquid, for example, a liquid such as a melt, on a solid surface. The solid surface may be, e.g., surface of a vessel. The wetting may be characterized by wetting temperature and/or wetting angle. Wetting could be characterized by the contact angle between the liquid and the solid surface. A contact angle less than 90° (low contact angle) usually indicates wetting of the surface is favorable, and the fluid will "wet" and spread over a large area of the surface such that there is "wetting." Contact angles greater than 90° (high contact angle) means that wetting of the surface is unfavorable so the fluid will minimize contact with the surface such that there is "no wetting" or "non-wetting" and form a compact liquid droplet. A liquid can be "wetting" on one solid surface and "non-wetting" on another solid surface.

By way of review, in embodiments of the injection molding systems, metal alloy is melted in a boat and then pushed through a shot sleeve into a mold by a plunger rod. The molten alloy has to move across multiple surfaces. In addition, the melting and plunger motion are intimately linked, which requires significant control to keep the metal alloy from interacting or losing too much heat. In addition, the boat has to be compatible with an induction system. For example, when the boat is made of copper alloy, the induction coil can't be any ferromagnetic materials because it'll build up heat in those materials and also absorb the applied power, generating inductive re-heating in the vicinity of tool steel.

With this said, the disclosed embodiments are directed to apparatus and/or methods to introduce the molten alloy, e.g., immediately before the mold (e.g., at a gate region of the mold), with the plunger or other like mechanism pushing (or ejecting) the molten alloy to the gate region of the mold, with an adjustable (e.g., minimum) transport path and/or contact between the plunger and the molten alloy, as the molten alloy being pushed. In one embodiment, the molten alloy can be introduced and transferred into a cold chamber as quickly as possible and with minimum interacting with the plunger. In addition, the melt zone can be separated from the cold chamber, which reduces or avoids inductive re-heating in the vicinity of tool steel. Melt and alloy introduction can be substantially completely separate from plunger and the cold chamber.

In embodiments, the disclosed apparatus can be a cold chamber die-casting system that does not include a crucible or a boat for the melting the alloy therein. The molten alloy can be introduced into the cold chamber at the last second, for example. The alloy feedstock may stay solid as desired, e.g., almost to the point at which it is introduced to the cold chamber. For example, immediately after the solid alloy feedstock turns molten, the molten material can be introduced (e.g., poured) into the cold chamber. These can be through the action of cooled fingers, in one embodiment, or because of some passive system for containing the melt until the last second, in another embodiment, which will be described in great details. This is different from existing cold chamber die-casters in which the alloy is kept in a heated crucible and then the crucible is tilted or poured in some other way to introduce it to the cold sleeves.

In embodiments, there is provided apparatus and methods for melting and introducing amorphous alloy feedstock for injection molding of material(s), e.g., amorphous alloys. As described below, parts of the apparatus are positioned in-line with each other. In accordance with some embodiments, parts of the apparatus (or access thereto) are aligned and/or operated on a horizontal axis. For example, the mold may be opened horizontally.

Figure 3:
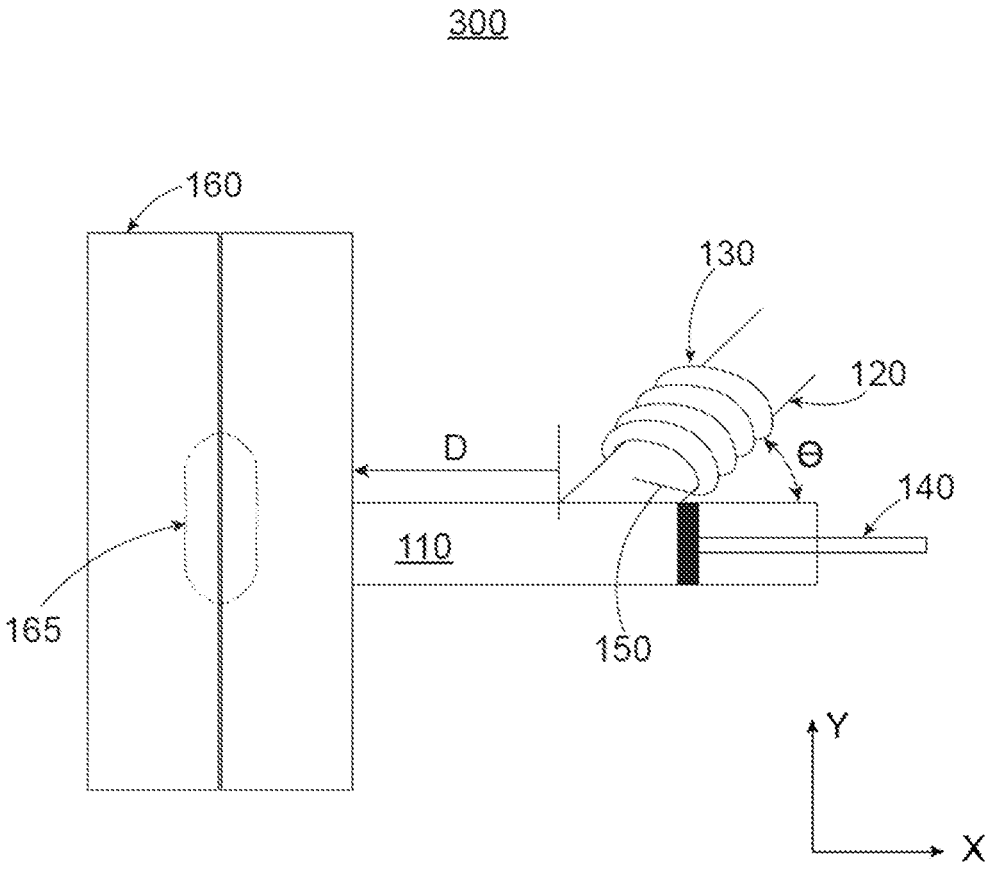
FIG. 3 illustrates an exemplary apparatus for molding in accordance with various embodiments of present teachings.

For example, an apparatus may include a cold chamber 110, a hollow branch 120, a heating component 130, a plunger-like mechanism 140, a constraint mechanism 150, a mold 160, etc., as shown in FIG. 3.

The cold chamber 110 can be, e.g., a channel, a pathway, a cold sleeve, a shot sleeve, a transfer sleeve, any analogous sleeve to a die-casting system for example, and a combination thereof. The cold chamber can be made of a material, for example, tool steel or lawn mower engineering materials, high strength steels, and/or any other possible materials. The cold chamber can be substantially horizontally configured and connected to the exemplary mold 160 for molding a molten alloy.

The hollow branch 120 can be configured extending upward from a region of the cold chamber 110 having an upward angle θ with respect to the horizontal axis. The upward angle θ of the hollow branch made with the horizontal axis can be, for example, between 0.degree. and 180.degree., such as about 15°, 30°, 43°, 50°, 60°, 90°, 140°, 167°, 180°, etc. The hollow branch 120 can be configured spaced apart from the mold 160, e.g., having a distance D between the mold and the hollow branch along the horizontal axis. In embodiments, the upward angle and/or the length of the hollow branch, and the distance D can be controlled when configuring the apparatus 300 in FIG. 3. For example, the distance D can be controlled to be a minimal distance such that the molten material introduced from the hollow branch travels a minimum distance through the cold chamber 110 and into the mold 160. Of course, the distance D is not limited in any manner in accordance with various embodiments of the present teachings.

In a certain embodiment, when the hollow branch 120 is configured in a mold tooling depicted in FIG. 3 as an example having the minimum distance D between the hollow branch 120 and the mold 160, molten alloys can be introduced, e.g., immediately after the alloy feedstock is melted, from the hollow branch 120 into the cold chamber 110 and, e.g., in front of the mold 160. The plunger 140 can then push it through the cold chamber 110 by the minimum distance D.

Note that although FIG. 3 depicts one hollow branch 120, one of ordinary skill in the art would appreciate that more than one hollow branch can be included, e.g., for parallel and/or sequential operations of different batches of alloy feedstock. In embodiments, when a plurality of hollow branches 120 is configured, they can be arranged as desired, e.g., arrayed in parallel or other configurations along the perimeter of the cold chamber 110, having same or different upward angles θ and/or lengths, having the same or different distances D from one or more molds (if not one mold), etc.

The hollow branch 120 can include the constraint mechanism 150 capable of, for example, (1) containing (e.g., holding) alloy feedstock in a solid form in place within the hollow branch; (2) containing (e.g., holding) the alloy, when the alloy is melting or becomes molten, i.e., in a liquid form, within the hollow branch; (3) introducing (e.g., pouring) the molten alloy, after a heating and/or melting process in the hollow branch 120, into the cold chamber 110 for molding, etc.

In other words, the hollow branch 120 including a constraint mechanism can be used as, a feedstock loading branch, a melt branch, and/or a melt introduction branch. The hollow branch 120 can melt the alloy feedstock into a molten alloy at the moment before injection of the molten material into the mold 160. In this manner, there is less chances of contamination in the system because the solid feedstock is intentionally kept at room temperature until the heating process (e.g., by turning on an induction power) starts.

The constraint mechanism 150 can be configured within the hollow branch 120 over the cold chamber 110. For example, the constraint mechanism 150 can be configured at a bottom end or near-bottom of the hollow branch 120 or at a desired point from the bottom end along a height of the hollow branch such that the alloy feedstock can be held in place and melted as desired.

The constraint mechanism 150 in the hollow branch 120 can include such as, for example, fingers, grids, a constriction, a step, a detent, a plate, and/or other constraint mechanism. The mechanical constraint can be extended, e.g., substantially horizontally, from one side of a wall of the hollow branch and configured within the hollow branch. The constraint mechanism is designed such that the surface of the constraint mechanism is non-wetting to the molten alloy. The mechanical constraint 150 can narrow the opening (e.g., diameter or width) of the hollow branch 120 in a horizontal direction. For example, the mechanical constraint 150 can itself have openings and gaps, or can be configured at least partially block the hollow branch, leaving a narrowed opening, in a horizontal direction. The narrowed horizontal opening can be sufficiently small to block the alloy feedstock to pass through and to hold the alloy feedstock thereon. Meanwhile, in some cases, the narrowed horizontal opening may be sufficiently large such that the molten material can pass through after the melting process. Alternatively, the mechanical constraint 150 may be configured completely block the hollow branch in a horizontal direction such that both the feedstock and the resulting molten material can be held thereon. In this case, the mechanical constraint 150 may be retractable from the hollow branch 120 to provide openings when desired, e.g., to pour the molten material into the cold chamber 110.

The constraint mechanism 150 can have a regulated surface temperature, e.g., by a cooling channel configured under the constraint mechanism 150. Any kind of coolants can flow in the cooling channel and can be used to provide a low surface temperature. The coolant can be any fluid capable of providing cooling effect. The coolant may include, e.g., water, gas such as inert gas, oil, etc. The flow rate and/or the temperature of the coolant can be controlled as desired. In some cases, when the alloy feedstock is melted thereon, a skull layer can be formed due to the regulated low surface temperature, e.g., at the contact point with the molten material, e.g., at a melting temperature or higher. In some cases, even when the constraint mechanism 150 is fingers, grids, or other mechanism having suitable openings, the surface tension of the molten material and the formation of skull layer can hold the molten material on the constraint mechanism 150. The molten material will not flow through the openings in the fingers or grids, e.g., under gravity, unless the fingers or grids are retracted from the hollow chamber and/or their openings are changed, e.g., enlarged. For example, by retracting the mechanism 150 from the hollow branch to provide an opening, between the mechanism 150 and wall of the hollow branch, sufficiently large to pass the molten material therethrough, and/or rotating the fingers or grids to increase gaps between adjacent fingers or grids such that the molten material can pass through these gaps.

To melt the alloy feedstock placed over the constraint mechanism 150 in the hollow branch, a melt zone can be provided and/or adjusted by the heating component 130. Accordingly, the heating component 130 can be configured to be associated with the hollow branch 120 having the constraint mechanism 150 therein. For example, the heating component can be associated with at least a portion of the hollow branch to provide the melt zone to heat and/or melt the alloy feedstock. The heating component 130 can heat and melt the alloy feedstock by one or more processes including, but not limited to, an induction heating, a joule heating, a radiation heating, and a combination thereof. In embodiments, the heating component 130 can include an induction coil configured surrounding the hollow branch 120. In embodiments, the position of the heating component 130 can be adjusted as desired. Accordingly, a melt zone can be adjusted, e.g., along the hollow branch, to melt the alloy feedstock directionally, for example, starting from a top side and ending at a bottom side until arriving at the constraint mechanism 150. This allows the molten alloy to form right before it is introduced into the cold chamber, e.g., through openings in the constraint mechanism 150 or by retracting the constraint mechanism 150.

In this manner, pieces of alloy feedstock can be placed and held in the hollow branch 120 above the cold chamber 110. In embodiments, the heating component 130 such as the induction coil can be configured adjacent to the cold chamber. In some cases, the cold chamber can be shielded from the induction coil as desired. Undue heating can then be avoided.

An exemplary hollow chamber configuration could have a constraint mechanism in accordance with various embodiments of the present teachings. The configuration can include a constraint mechanism (see 150 in FIG. 3), for example, a plurality of fingers, that allows the alloy feedstock to form a skin layer on the plurality of fingers. The fingers can be substantially horizontally configured, for example, arrayed or aligned, to stick out from one side of the wall of the hollow chamber to at least partially cover a horizontal cross section. The fingers can physically block the passage of the alloy feedstock in a solid form.

The fingers can be fluid-cooled, for example, water-cooled, using a cooling channel, such that when the induction power of the heating component (see 130 in FIG. 3), e.g., induction coils, is turned on to heat and melt the alloy feedstock into a molten alloy, the molten alloy will not flow through gaps between the fingers and/or through any openings between the figures and adjacent inner surface of the hollow branch 120 shown in FIG. 3. The fingers may be configured sufficiently close with one another. The molten alloy can be held in place on the fingers due to surface tension and/or the skin layer formed at the interface between the molten material and the cooled-fingers.

In this manner, when the alloy feedstock travels in a solid form into a melt zone, e.g., the region of the hollow branch 120 surrounded by induction coils 130 in FIG. 3, the cooled fingers beneath the alloy feedstock will stop the feedstock from dropping into the cold chamber. Then after the induction power is turned on, the molten alloy is formed and it sits on top of the fingers, due to surface tension and the formation of a skin layer at the interface between the molten material and the cooled fingers. The molten feedstock is prevented from flowing into the cold chamber 110 of FIG. 3 until the surface tension is sufficient to maintain a skin layer between the molten material and the cooled fingers without rupturing the skin layer. Once the molten material is formed and held on the fingers within the hollow branch 120 in FIG. 3, the molten material can be introduced into the cold chamber 110 by, for example, retracting the fingers to provide an opening sufficiently large for the molten alloy to pass through, or by rotating the fingers to increase the gaps between them such that the molten alloy can pass through. Once the molten alloy passes through the hollow branch 120 and is poured into the cold chamber 110, the plunger 140 may push the molten alloy into, e.g., a mold cavity 165 of the mold 160 shown in FIG. 3.

Figure 4:
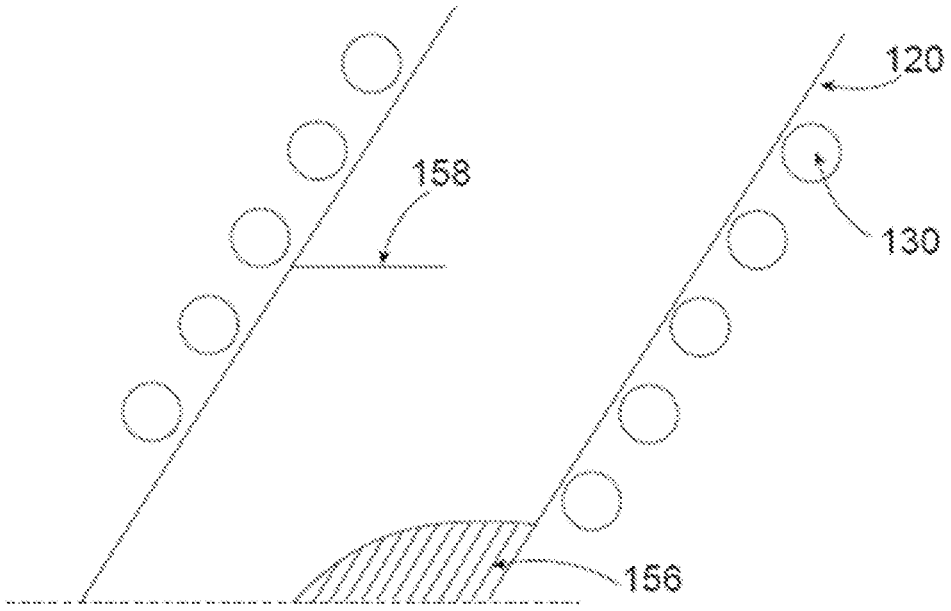
FIG. 4 illustrates another exemplary hollow branch configuration in accordance with various embodiments of present teachings.

FIG. 4 depicts an exemplary hollow chamber configuration 500 having a constraint mechanism in accordance with various embodiments of the present teachings. The configuration 500 can include a hollow branch 120 having one or more constraint mechanisms 156, 158. The constraint mechanisms 156, 158 can be any mechanism as disclosed in FIG. 3, e.g., a constriction, step, detent, plate and/or fingers. For example, a step can be configured to stick into the hollow branch 120 from one side of the wall of the hollow branch 120 to provide a narrowed opening within the hollow branch 120 so that the alloy feedstock in a solid form cannot go through that opening but hold in place on the one or more constraint mechanisms. Therefore, the solid feedstock can travel into the hollow branch 120 and then be stopped by the constraint mechanisms 156 or 158.

In embodiments, the narrowed opening may not be sufficiently small to hold a molten material (i.e., molten alloy) formed thereon. In this case, the melt zone can be controlled or adjusted. For example, in an induction melt zone, the induction coil may be oriented having coil turns spaced such that the alloy feedstock melts from the furthest point to a corresponding constriction mechanism. For example, starting from a top side of the alloy feedstock and ending at a bottom side of the feedstock at the constraint mechanism. The melt zone can be adjusted by adjusting the coil position such that it is offset to one side (e.g., a top side) of the alloy feedstock. In this manner, the melting material can be kept from going into the cold chamber until it is fully molten within the hollow branch 120.

In embodiments, the heating component 130 such as the induction coil can travel upward along the hollow branch 120 and to extend a little further than the hollow branch to melt one side (e.g., the very top side) of the alloy feedstock first, because the heat of the applied RF energy by the induction coil can be concentrated on one side more than the other. When the melt zone finally reaches the constraint mechanism 156 or 158, it allows the alloy to pass through. In other words, the constraint mechanism can server as a passive containment for containing the alloy feedstock up until the point that it is fully molten and then the molten material naturally falls into the cold chamber to be injected.

The above embodiments are for illustrative purposes only and are not meant to be limiting. In embodiments, the alloy feedstock may include any types of alloys. In one embodiment, the alloy feedstock may be alloys for forming BMG articles using the apparatus and methods shown in FIGS. 3 and 4.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A method comprising molding a molten alloy into a BMG part in an apparatus comprising:

a cold chamber substantially horizontally configured and connected to a mold configured for molding the molten alloy into the BMG part; and a hollow branch extending upward from a region of the cold chamber having an upward angle with a horizontal axis, the hollow branch comprising a constraint mechanism capable of containing both a solid alloy feedstock during melting into the molten alloy in the hollow branch and the molten alloy prior to introducing the molten alloy to the cold chamber for molding;

wherein an interface between the constraint mechanism and the molten alloy is substantially non-wetting to the molten alloy, wherein the constraint mechanism is configured to be cooled by a coolant to cool the constraint mechanism to regulate a temperature of the interface.

2. The method of claim 1, further comprising a heating component configured associated with the hollow branch to provide a melt zone along the hollow branch.

3. The method of claim 1, further comprising a plunger configured to push the molten alloy from the cold chamber into the mold.

4. The method of claim 1, wherein the constraint mechanism comprises a surface having a regulated surface temperature.

5. The method of claim 1, wherein the constraint mechanism comprises a plurality of fingers, a constriction, a step, a plate, a rod, a detent, or their combinations, extended from a side of a wall of the hollow branch and configured within the hollow branch.

6. The method of claim 1, wherein the constraint mechanism provides a narrowed horizontal opening within the hollow branch to block the alloy feedstock pass through.

7. The method of claim 1, wherein the constraint mechanism is retractable or rotatable to adjust an opening within the hollow branch.

8. The method of claim 1, further comprising configuring a plunger rod to push the molten alloy from the cold chamber into the mold.

9. The method of claim 1, wherein the constraint mechanism comprises a plurality of fingers or grids and wherein the introducing of the molten material comprises:

rotating the constraint mechanism or one or more fingers or grids thereof to provide an opening to introduce the molten material there-through.

10. The method of claim 1, wherein the constraint mechanism provides a narrowed horizontal opening in the hollow branch to hold the alloy feedstock in place.

11. The method of claim 10, wherein the heating comprises controlling a melt zone along the hollow branch to melt the alloy feedstock directionally starting from a top side and ending at a bottom side until at the constraint mechanism, wherein the molten alloy passes through the narrowed opening into the cold chamber.

12. A method comprising molding a molten alloy into a BMG part in an apparatus comprising:

a cold chamber substantially horizontally configured and connected to a mold configured for molding the molten alloy into the BMG part; and a hollow branch extending upward from a region of the cold chamber having an upward angle with a horizontal axis, the hollow branch comprising a constraint mechanism capable of containing both a solid alloy feedstock during melting into the molten alloy in the hollow branch and the molten alloy prior to introducing the molten alloy to the cold chamber for molding;

wherein an interface between the constraint mechanism and the molten alloy is substantially non-wetting to the molten alloy, wherein the constraint mechanism comprises a cooling channel to regulate a temperature of the interface.

13. The method of claim 12, further comprising a heating component configured associated with the hollow branch to provide a melt zone along the hollow branch.

14. The method of claim 12, wherein the apparatus comprises a die-casting apparatus that does not include a melt crucible.

15. The method of claim 12, wherein the cold chamber is shielded from a heating component associated with the hollow branch.

* * * * *